US007548222B2

(12) United States Patent
Le Roy et al.

(10) Patent No.: US 7,548,222 B2
(45) Date of Patent: Jun. 16, 2009

(54) ACTIVE-MATRIX DISPLAY, THE EMITTERS OF WHICH ARE SUPPLIED BY VOLTAGE-CONTROLLED CURRENT GENERATORS

(75) Inventors: Philippe Le Roy, Betton (FR); Christophe Prat, Nantes (FR); Pierrick Martin, Rennes (FR)

(73) Assignee: Thomson Licensing, Boulogne-Billancourt (FR)

( * ) Notice: Subject to any disclaimer, the term of this patent is extended or adjusted under 35 U.S.C. 154(b) by 605 days.

(21) Appl. No.: 11/403,778

(22) Filed: Apr. 13, 2006

(65) Prior Publication Data

US 2006/0232522 A1 Oct. 19, 2006

(30) Foreign Application Priority Data

Apr. 14, 2005 (FR) ..... 05 50954

(51) Int. Cl.
*G09G 3/32* (2006.01)

(52) U.S. Cl. ..... 345/82; 345/76; 345/92; 345/100; 315/169.1

(58) Field of Classification Search ..... 345/76–83, 345/87–100, 204; 315/169.1–169.4
See application file for complete search history.

(56) References Cited

U.S. PATENT DOCUMENTS 7,126,518 B2 * 10/2006 Tsuchi ..... 341/144
7,176,910 B2 * 2/2007 Tsuchi ..... 345/204
2001/0030888 A1 * 10/2001 Chang ..... 365/185.03
2002/0018059 A1 * 2/2002 Yanagi et al. ..... 345/204
2003/0030603 A1 2/2003 Shimoda
2004/0263504 A1 * 12/2004 Kato ..... 345/204
2005/0017190 A1 * 1/2005 Eversmann et al. .... 250/370.14
2005/0035811 A1 * 2/2005 Shin ..... 327/536
2005/0073358 A1 * 4/2005 Nakahira ..... 330/9
2005/0088329 A1 * 4/2005 Tsuchi ..... 341/144
2005/0219097 A1 * 10/2005 Atriss et al. ..... 341/144

* cited by examiner

*Primary Examiner*—Richard Hjerpe
*Assistant Examiner*—Kimnhung Nguyen
(74) *Attorney, Agent, or Firm*—Robert D. Shedd; Harvey D. Fried; James M. McKenzie

(57) ABSTRACT

The display comprises an array of pixel circuits each comprising an emitter 1 in series with a current modulation transistor, and at least one address circuit, which integrates, for each column, a differential amplifier and a passive element preferably a resistive element, which cooperate with the current modulation transistors so as to form, during address phases in which the emitters are switched "out of the circuit", a voltage-programmable current generator. After the address phases, thanks to a suitable switch, the emitters are switched "into the circuit" and supplied with the preprogrammed current. Such a display allows the image display quality to be inexpensively improved.

11 Claims, 2 Drawing Sheets

ACTIVE-MATRIX DISPLAY, THE EMITTERS OF WHICH ARE SUPPLIED BY VOLTAGE-CONTROLLED CURRENT GENERATORS

This application claims the benefit under 35 U.S.C. § 119 of French Patent Application 0550954, filed Apr. 14, 2005.

FIELD OF THE INVENTION

The invention relates to displays comprising an array of light emitters, especially organic light-emitting diodes, and to a method of driving these displays.

DESCRIPTION OF THE PRIOR ART

Document U.S. Pat. No. 6,809,706 describes, with reference to its FIG. 12A and by adopting the same references as in that document, an active-matrix display comprising an array of light emitters 1 of the current-controllable type and an array of pixel circuits 10 each comprising an emitter 1, that are distributed in rows and columns, a voltage generator $V_{DD}$ for supplying said emitters having first and second supply output terminals, a circuit capable of selecting pixel circuits for any one row and a circuit 25 capable of simultaneously addressing a voltage representative of an image datum to be displayed at each of the pixel circuits of any one row selected, where each pixel circuit 10 includes, in addition to the emitter 1 that can be supplied between first and second supply input terminals:

- a voltage-controlled current modulation transistor ($Tr_2$), comprising a voltage drive electrode and two current electrodes, namely what is called a source electrode which is connected to said first supply input terminal of the emitter, and what is called a drain electrode which is connected to said first supply output terminal of the generator;
- a first switch $Tr_1$ and a second switch $Tr_3$, each provided with a drive electrode; and
- a memory element $C_1$ capable of storing (especially when the first switch is closed) and maintaining (especially when the first switch is open), over the duration of display of an image, a drive voltage on said drive electrode of the modulation transistor $Tr_2$,
- in which the data address circuit 25 comprises, for each column of pixels, first 13 and second 12 column electrodes, a differential amplifier 2 having an output connected to said first column electrode 13, an inverting input connected to said second column electrode 12, and a non-inverting input for addressing said voltage representative of an image datum,
- said first column electrode 13 being connected to the drive electrode of the modulation transistor of each of the pixel circuits of said column via said first switch $Tr_1$ of this circuit,
- said second column electrode 12 being connected to said first supply input terminal of the emitter 1 of each of the same pixel circuits via said second switch $Tr_3$ of this circuit and
- in which the row select circuit comprises, for each row of pixels, at least one row electrode 14 that is connected to the drive electrode of the first $Tr_1$ and second $Tr_3$ switches of each of the pixel circuits 10 of this row.

Thanks to such an address circuit, the operational amplifier 2 of the address circuit 25 then forms, with the current modulation transistor $Tr_2$ and the emitter 1 of a pixel circuit 10 during the address phase, a current generator that is controlled by the voltage $V_{data}$ representative of the image datum applied to the non-inverting input of this differential amplifier. Such a display therefore allows voltage-addressing of emitters that are nevertheless current-controllable. Furthermore, as the source electrode of this modulation transistor $Tr_2$ is connected to the inverting input of this operational amplifier 2, there is therefore a source follower circuit so that the potential difference across the terminals of the emitter 1 is then equal to the voltage $V_{data}$ representative of the image datum, the trip threshold voltage of the modulation transistor $Tr_2$ then being compensated for by the differential amplifier 2. Such a display therefore allows images to be displayed while getting round the problem of any fluctuation and/or drift in the trip threshold voltage of the current modulation transistors of the pixel circuits.

The active matrix of such a display integrates all the pixel circuits with the exception of their emitters, which are themselves deposited on the active matrix. The transistors $Tr_1$, $Tr_2$, $Tr_3$ of the circuits integrated into this active matrix are in this case n-type transistors and, in each current modulation transistor $Tr_2$, the current flows from the drain electrode to the source electrode (the current flows in the reverse direction in p-type transistors). For economic reasons, the active layers of these transistors are preferably made of amorphous or microcrystalline silicon, which is by nature always of n type. The emitters deposited on the active matrix are generally light-emitting diodes. Each diode comprises several layers, namely an anode, an organic light-emitting layer, which is itself subdivided into several organic sublayers, and a cathode. In the circuit shown in FIG. 12A of document U.S. Pat. No. 6,809,706, these layers are deposited in the following order: anode, as lower electrode connected to the source electrode of the transistor $Tr_2$ integrated into the active matrix; then the organic layer; and then the cathode as upper electrode, connected here to a ground electrode. Such an organic diode structure is said to be "conventional", as opposed to what is called an "inverted" structure in which the cathode would be the lower electrode and the anode the upper electrode.

Documents EP 1 269 798, EP 1 381 019 and U.S. Pat. No. 6,661,180 (see for example embodiment No. 11) describe displays in which the address circuit also includes an operational amplifier, as in document U.S. Pat. No. 6,809,706.

In a pixel circuit 10 of the display described above with reference to document U.S. Pat. No. 6,809,706, which includes a modulation transistor $Tr_2$, if $V_{gs}$ is the potential difference between the drive electrode of this transistor, also called the gate electrode g, and its source electrode s, and if $V_{th}$ is the trip threshold voltage of this transistor $Tr_2$, the current $I_d$ that flows between the current electrodes of this transistor $Tr_2$ is equal to:

$I_d=k(V_{gs}-V_{th})^2$, where k is a constant that depends on intrinsic parameters of the transistor.

The potential difference $V_{DD}$ is then divided between:

- a potential difference $V_{ds}$ at the terminals of the current electrodes of the modulation transistor $Tr_2$; and
- a potential difference $V_e$ at the terminals of the emitter 1, which itself depends on the current $I_d$ modulated by the transistor $Tr_2$.

The voltage $V_s$ of the source electrode s of the transistor $Tr_2$ therefore depends on the current $I_d$ modulated by this same transistor $Tr_2$, according to the current-voltage characteristics of the emitter 1, which characteristics themselves fluctuate according to the ageing of this emitter.

Owing to the variations in the voltage $V_s$, the modulation and the programming of the current to be made to flow through the emitter no longer depends only on the voltage applied to the drive electrode of the modulation transistor $Tr_2$ but also on the charge and on the ageing of the emitter, thereby introducing defects into the images displayed by the display.

To remedy this drawback, pixel circuit configurations are therefore sought in which the source voltage $V_s$ of the current modulators $Tr_2$ are constant when current is being programmed using these circuits.

One solution would consist in using diodes with an inverted structure as emitter, with an anode as upper electrode at the potential $V_{DD}$ and a cathode as lower electrode connected to the drain electrode of the current modulation transistor $Tr_2$. The source electrode s of this transistor is then connected to a constant potential GND, thereby achieving a constant source voltage $V_s$. However, such diodes with an inverted structure generally have a lower efficiency and/or a shorter lifetime, especially when the anode is made of a mixed indium tin oxide (ITO). This is because the ITO layers must in general be vacuum-deposited by cathode sputtering with an energy that degrades the underlying organic layers when such a layer is deposited as upper electrode.

Another solution would consist in using p-type transistors as current modulators, in which the current flows from the source electrode to the drain electrode, while retaining diodes with a conventional structure. The source electrode of the modulation transistors $Tr_2$ is then at the constant potential $V_{DD}$. However, such a solution based on p-type transistors precludes the use of amorphous or microcrystalline silicon for the active matrix and requires the much more expensive use of recrystallized silicon.

SUMMARY OF THE INVENTION

It is one object of the invention to provide a solution that allows both the use of diodes with a conventional structure, with the cathode as the upper layer, and the use of n-type silicon for the current modulation transistors of the active matrix, so as to offer higher efficiency and/or longer lifetime at lower cost.

For this purpose, the subject of the invention is an active-matrix display comprising an array of light emitters of the current-controllable type and an array of pixel circuits, each comprising at least one of said emitters that are distributed in rows and columns, at least one generator for supplying said emitters having first and second supply output terminals, at least one circuit capable of selecting pixel circuits for any one row and at least one circuit capable of simultaneously addressing a voltage representative of an image datum to be displayed at each of the pixel circuits of any one row selected, where each pixel circuit comprises, in addition to at least one emitter:

- a voltage-controlled current modulation transistor, comprising a voltage drive electrode and two current electrodes, namely what is called a source electrode and what is called a drain electrode which is connected to said first supply output terminal of the at least one generator;
- a first switch and a second switch, each provided with a drive electrode; and
- a memory element capable of charging and maintaining, over the duration of display of an image, a drive voltage on said drive electrode of the modulation transistor,
- in which at least the one data address circuit comprises, for each column of pixels, first and second column electrodes, a differential amplifier having an output connected to said first column electrode, an inverting input connected to said second column electrode, and a non-inverting input for addressing said voltage representative of an image datum,
- said first column electrode being able to be connected to the drive electrode of the modulation transistor of each of the pixel circuits of said column by means of said first switch of this circuit,
- said second column electrode being able to be connected to said source electrode of the current modulation transistor of each of the same pixel circuits by means of said second switch of this circuit and
- in which the at least one row select circuit comprises, for each row of pixels, at least one row electrode that is connected to the drive electrode of the first and second switches of each of the pixel circuits of this row, wherein:

- the at least one data address circuit comprises, for each column of pixels, a passive element having two terminals, one being connected to said second column electrode of said column, the other being connected to the second supply output terminal of the at least one generator; and
- said display includes at least a third switch able to connect, through the at least one emitter of each of the pixel circuits, said source electrode of the current modulation transistor of said pixel circuit to the second supply output terminal of the at least one generator.

When said third switch corresponding to at least one pixel circuit is open and the first and second switches of this circuit are closed, the current modulation transistor of this pixel circuit then forms a voltage-controlled current generator with the differential amplifier and the passive element of the column of this pixel.

When said third switch corresponding to at least one pixel circuit is closed and the first and second switches of this circuit are open, the memory element of this circuit maintains a constant voltage on the drive electrode of the current modulation transistor of this pixel circuit and the current generated by the supply generator then flows through the emitter of this circuit.

Preferably, the memory element of each pixel circuit is a capacitor capable of storing an electric charge during the period of an image frame.

Preferably, said passive element of each address circuit is a resistor. The value of this resistor $R_1$ is set according to the ranges of voltages $V_{data}$ representative of image data on the one hand, and ranges of currents $I_d$ to be made to flow through the emitters in order to obtain the luminance necessary for displaying the images, so that $R_1=V_{data}/I_d$.

Preferably, each current modulation transistor is an n-type transistor. In these transistors, the current therefore flows from the drain electrode to the source electrode.

Preferably, the transistors and the switches of the pixel circuits, which are integrated in the active matrix, all comprise a thin film of amorphous silicon—they are then therefore all n-type transistors and switches. Such an active matrix is particularly inexpensive.

To summarise, the display according to the invention comprises an array of pixel circuits each comprising at least one emitter in series with a current modulation transistor, and at least one address circuit, which integrates, for each column of pixel circuits, a differential amplifier and a passive element, preferably a resistive element, which cooperate with the current modulation transistors so as to form, during address phases in which the emitters are switched "out of the circuit", a voltage-programmable current generator. After the address phases, thanks to a suitable switch $Tr_4$, the emitters are switched "into the circuit" and supplied with the preprogrammed current.

Compared with document US 2003/117082, the invention provides an important simplification, especially because the display according to the invention comprises only a single differential amplifier per address circuit and not a differential amplifier per pixel circuit as in US 2003/117082. Furthermore, in US 2003/117082, the operating principle is completely different since the pixel circuit is intended in this case to detect the trip threshold voltage of the modulation transistor of the pixel circuits and then, by means of the differential amplifier, to add the voltage representative of an image datum to the drive electrode for this transistor.

Compared with document EP 1 381 019 (see FIG. 7 and FIG. 11 of that document), which describes a display having only a single differential amplifier per address circuit, the circuit for addressing each pixel column and the third switch of the display according to the invention may advantageously cooperate so that, during current programming phases for each pixel circuit, the programming current flows via the passive element and not via the emitter of this circuit, thereby ensuring better programming of the circuits as illustrated below.

Compared with document U.S. Pat. No. 6,661,180, which also describes a display having only a single differential amplifier per address circuit, it may be seen that the output of the differential amplifier of each address circuit of the display according to the invention is connected, via said first column electrode and said first switch of each pixel circuit of this column, to the drive electrode of the modulation transistor of this circuit and not to the drive electrode of a modulation transistor belonging to the address circuit, as in U.S. Pat. No. 6,661,180 (see reference 412). This is the reason why the circuit according to the invention requires a second column electrode for feedback of the differential amplifier—this feedback circuit passes via the modulation transistor of the pixel circuits, whereas this feedback takes place directly at the address circuit in U.S. Pat. No. 6,661,180. Furthermore, the operating principle is completely different in U.S. Pat. No. 6,661,180, in particular owing to the cutting-up of the image frames or subframes in order to drive the display.

Compared with document U.S. Pat. No. 6,693,388 (see especially FIG. 7), which also describes a display having only a single differential amplifier per address circuit, the feedback circuits of the differential amplifiers pass via the modulation transistor of the pixel circuits, as in the invention. In document U.S. Pat. No. 6,693,388, the feedback circuits pass by the emitter of the circuits, unlike in the invention. The feedback circuits in the invention pass via the passive element of the address circuits, thereby advantageously resulting in current programming that is independent of the variations in the voltage-current properties of the emitters. Furthermore, the circuits described in document U.S. Pat. No. 6,693,388 are more expensive for the following reasons:

compensation of the trip threshold voltage of the modulation transistors of the pixel circuits is achieved by means of a current mirror circuit (see ref. T3 and T4), thereby requiring two additional transistors in each pixel circuit; and the two switches (see ref. T2 and T5) of each pixel circuit are controlled by separate row electrodes, thereby requiring an additional array of row electrodes.

According to the invention, the combination of the third switch and the passive element, preferably a resistor $R_1$, makes it possible:

when this third switch is open, to take the emitters to which this switch is connected out of the circuit, to store, in the memory element of the pixel circuits comprising these emitters, a voltage capable of generating a current in the passive, here resistive, element of the address circuit for these circuits, by applying a voltage $V_{data}$ representative of an image datum to the non-inverting input of the operational amplifier of this address circuit—the current generated by the supply generator then flows via these resistive elements, and not via the emitters of the circuits being addressed, and the current generated $I_d$ is directly proportional to the voltage representative of the image datum according to the equation $I_d=V_{data}/R_1$; and when this third switch is closed, the memory element having stored a drive voltage capable of generating this current $I_d$, to switch these emitters back into the circuit supplied by the generator and to make said current $I_d$ flow therein, preferably from the same supply generator.

Thanks to this third switch and the passive, here resistive, element, it is possible to programme the current in each pixel circuit while getting round the problem of variations in the voltage $V_s$ of the source electrode of the modulation transistors, and therefore also getting round the problem of the charging and ageing of the emitters.

Preferably, the emitters of the display according to the invention are organic light-emitting diodes.

Preferably, these diodes each comprise an organic electroluminescent layer inserted between an anode formed by a lower conducting layer in contact with the active matrix and a cathode formed by an upper conducting layer. The active matrix forms a substrate that integrates the array of pixel circuits.

Preferably, the cathodes of the various diodes form one and the same conducting layer common to all the diodes. This common electrode is generally produced by a conducting layer covering the entire active surface of the display.

Preferably, each emitter has two supply input terminals, namely an anode and a cathode, and:

in each pixel circuit, the anode of the at least one emitter is connected to the source electrode of the modulation transistor of the circuit; and the at least one third switch is able to connect the cathode of the at least one emitter of each of the pixel circuits to the second supply output terminal of the at least one generator.

The subject of the invention is also a method of driving a display according to the invention for displaying a succession of image frames, each image being made up of a set of image data, each datum being associated with a pixel of this image and with a representative voltage $V_{data}$ to be addressed to the circuit of this pixel, wherein it comprises, for displaying each image, a suitable programming phase for programming at least one set of pixel circuits in order to charge, in the memory element of each of the circuits of this set, a drive voltage capable of generating, via the modulation transistor of said circuit and the passive element of the address circuit for this circuit, a current $I_d$ proportional to the representative voltage $V_{data}$ addressed to this circuit, and an emission phase in which the emitters of the circuits of this set emit in which, for each of the circuits of this set, the same drive voltage is maintained by the memory element on the drive electrode of the modulation transistor of this circuit so as to generate, via the modulation transistor of said circuit and the at least one emitter of this pixel circuit, the same current $I_d$ as during the programming phase.

Preferably, during each address phase, the at least one third switch which is able to connect, via the at least one emitter of each of the pixel circuits of said set, the source electrode of the current modulation transistor of said pixel circuit, to the second supply output terminal of the at least one generator, is open and in that, during each emission phase, the at least one third switch is closed.

When the third switch is closed, the current $I_d$ flows via the passive element of the address circuits, while when this switch is closed the same current $I_d$ flows via the emitters and not via the passive element of the address circuits. No longer programming the currents via the emitters, as in the prior art, advantageously gets round the problem of any variations in the electrical, especially current-voltage, characteristics of the emitters, thereby achieving better image display quality.

Preferably, during each address phase for a set of pixel circuits belonging to different rows, each of said different rows of pixel circuits is selected, by means of the at least one selection circuit, by applying, to the electrode of each row selected in succession, a logic signal capable of closing the first and second switches of each pixel circuit of said row belonging to said set.

Preferably, during said selection of each row of pixel circuits of said set, the voltage representative of the image datum that corresponds to said pixel is applied, by means of the at least one address circuit, to the non-inverting input of the operational amplifier of each pixel circuit of said row belonging to said set.

Thus during each address phase, when a row is selected, since the second switches of the pixel circuits of this row are closed and at the least one third switch corresponding to these circuits is open, the current generated by the supply generator flows through the modulation transistor of each pixel circuit and through the passive element connected to the second electrode of the column to which said circuit belongs. Furthermore, since the first switch of this pixel circuit is also closed, the differential amplifier whose output is connected to the first column electrode to which said circuit belongs then forms, with said modulation transistor and said passive element, a current generator that is controlled by the voltage representative of the image datum applied to the non-inverting input of this differential amplifier. Advantageously, this current generator is programmed on a passive element and not on an emitter—it thus gets round the problem of dynamic impedance or "kink" effects of the emitters. Advantageously, this current generator is programmed on the same passive element for all the pixel circuits of the same column, which avoids having one passive element per pixel circuit. Furthermore, since the source electrode of this modulation transistor is then connected to the inverting input of this differential amplifier, what is therefore obtained is a source follower circuit so that the potential difference across the terminals of the passive element is then equal to the voltage representative of the image datum, the trip threshold voltage of the modulation transistor then being compensated for by the differential amplifier.

Thus, during each emission phase of the emitters belonging to a set of pixel circuits, the first and second switches of these pixel circuits are open and the at least one third switch corresponding to these circuits is closed, so that the current generated by the same supply generator flows through the modulation transistor of each pixel circuit of this set and, this time, through the at least one emitter of this circuit, the passive elements of the address circuits of these circuits being now out of the circuit.

The current flowing in each emitter during this emission phase is equal to the programmed current in each pixel circuit during the programming phase and is therefore strictly proportional to the voltage representative of an image datum addressed to each pixel circuit during the programming phase. One advantage of the invention is that this current does not depend on the trip threshold voltages of the current modulation transistors of each circuit, nor on the current-voltage characteristics of the emitters, nor on any drift in these voltages and/or in these characteristics.

BRIEF DESCRIPTION OF THE DRAWINGS

The invention will be more clearly understood on reading the description that follows, given by way of non-limiting example and with reference to the appended figures in which.

The figures representing timing diagrams do not take the scale of values into account so as to better bring out certain details which would not be clear if the proportions had been respected.

To simplify the description and to bring out the differences and advantages afforded by the invention compared with the prior art, identical references are used for elements that fulfil the same functions.

DESCRIPTION OF THE PREFERRED EMBODIMENTS

Figure 1:
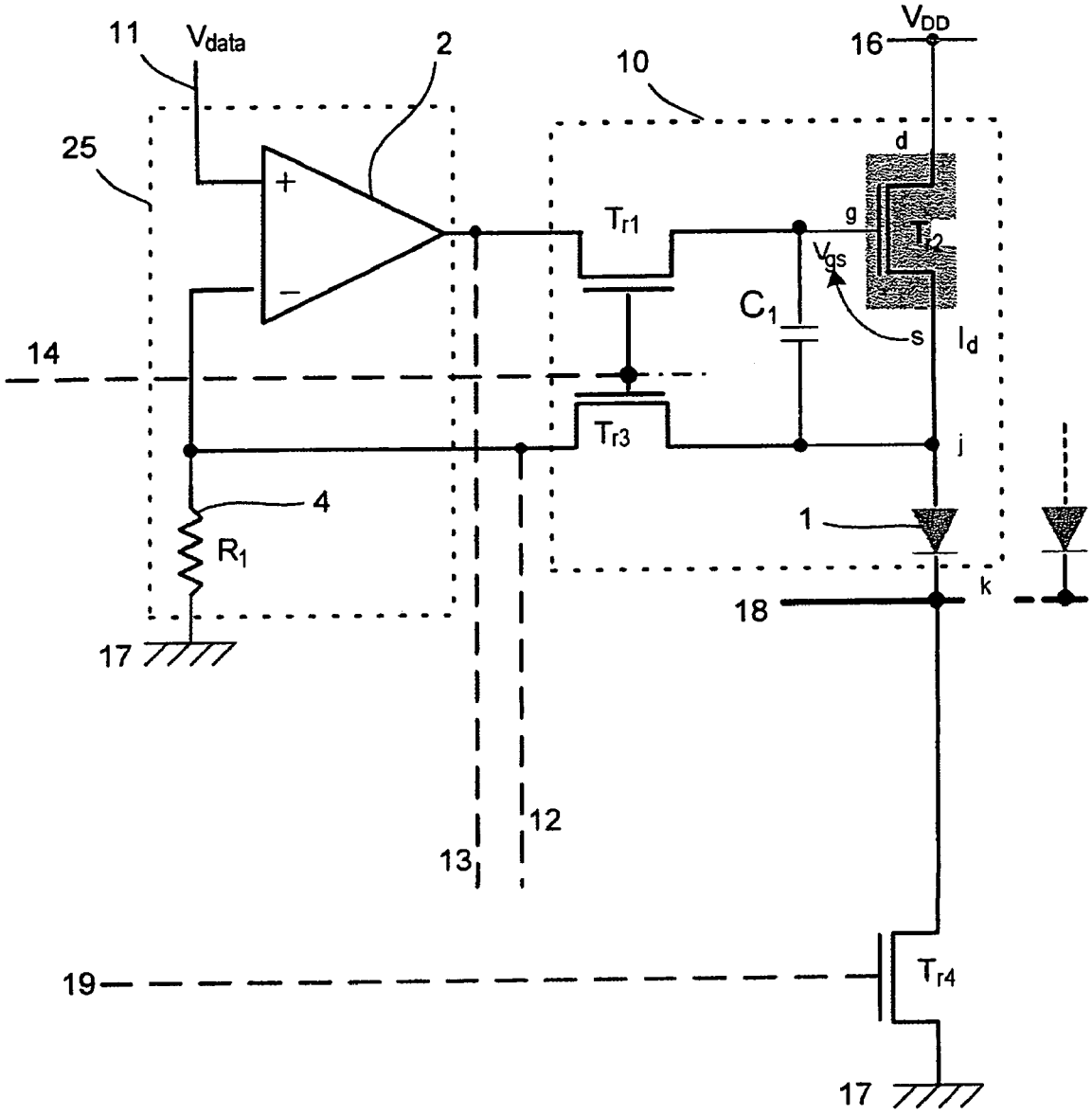
FIG. 1 illustrates a pixel circuit and an address circuit for a display in one embodiment of the display according to the invention.

One embodiment of a display according to the invention will be described with reference to FIG. 1.

The display according to the invention comprises an array of pixel circuits 10, each including an organic light-emitting diode 1. These circuits and diodes are distributed over the display in rows and columns, these circuits being integrated into an active matrix that supports the diodes.

The display also comprises:

- a supply generator (not shown) having a first output terminal at an approximately constant voltage $V_{DD}$ and a second output terminal connected to a ground electrode;
- a circuit (not shown) capable of selecting pixel circuits 10 of any one row, this circuit having, for each row of pixels, a single row select electrode 14; and
- a circuit 25 capable of simultaneously addressing each of the pixel circuits of any one row selected with a voltage representative of an image datum $V_{data}$. This circuit 25 comprises, for each column of pixels, first 13 and second 12 column electrodes, a differential amplifier 2 and a resistor 4 of value $R_1$. The differential amplifier 2 has an output connected to the first column electrode 13, an inverting input connected to the second column electrode 12 and a non-inverting input for addressing with said voltage representative of an image datum via an electrode 11. One of the terminals of the resistor 4 is connected to the inverting input of the differential amplifier 2, while the other terminal of this resistor is connected to the second output terminal of the generator via a ground electrode.

Each pixel circuit 10 comprises:

- a light-emitting diode 1 having a lower electrode in contact with the active matrix and an upper electrode, with at least one organic light-emitting layer inserted between the two electrodes. The lower electrode is an anode and the upper electrode is a cathode. This diode is therefore a light emitter, which can be supplied between a first terminal, corresponding to an anode, and a second terminal k corresponding to a cathode. The upper electrodes here form a single layer 18 so that the cathodes are all at the same potential;

a voltage-controlled current modulation transistor $Tr_2$, comprising a voltage drive electrode, called a gate electrode g, and two current electrodes, namely a source electrode s, which is connected to the first terminal (the anode) of the emitter, and a drain electrode d which is connected, via a row supply electrode 16, to the output terminal of the generator, which is at the voltage $V_{DD}$;

a memory element, here a capacitor $C_1$ connected between the gate electrode g of the modulation transistor $Tr_2$ and the source electrode s of this transistor; and a first switch $Tr_1$ capable of connecting the gate electrode g of the modulation transistor $Tr_2$ to the first column electrode 13, and a second switch $Tr_3$ capable of connecting the first terminal (the anode) of the emitter 1 and the source electrode s of the transistor $Tr_2$ to the second column electrode 12. Each switch $Tr_1$, $Tr_3$ is provided with a drive electrode that is connected to the row electrode 14.

The source electrode s of the transistor $Tr_2$ and one of the terminals of the second switch $Tr_3$ are connected to the node j, which is itself connected to the first terminal (the anode) of the emitter.

All the transistors of the pixel circuits are n-type transistors.

The first column electrode 13 is therefore connected to the drive electrode of the modulation transistor of each of the pixel circuits of this column via the first switch $Tr_1$ of this circuit, and the second column electrode 12 is therefore connected to the first terminal (the anode) of the emitter 1 of each of the same pixel circuits via the second switch $Tr_3$ of this circuit.

The display also includes a switch $Tr_4$ capable of connecting the upper electrode forming a single layer 18 of each emitter to a ground electrode 17, corresponding therefore to the second output terminal of the generator. This switch $Tr_4$ is provided with a drive electrode 19.

According to a variant, the upper electrodes are common only to the emitters of any one row. The upper electrode no longer forms a single layer, but an array of upper supply rows, each forming a cathode for the set of emitters of any one row. There is therefore one switch $Tr_4$ per upper supply row, this being capable of connecting the cathodes of the emitters of this row to a ground electrode 17, corresponding to the second output terminal of the generator. Each switch $Tr_4$ is provided with a drive electrode.

According to another variant, there is again one switch $Tr_4$ per pixel circuit, but this time placed so as to be able to connect the first terminal (the anode) of the emitter 1 to the node j that joins the source electrode s of the transistor $Tr_2$ to one of the terminals of the second switch $Tr_3$. Preferably, this switch is a thin-film transistor (TFT) produced in a semiconductor layer doped so as to create carriers (holes or electrons) of opposite charge to that of the carriers (electrons or holes, respectively) supplied by the dopants of the semiconductor layer of the second switch $Tr_3$. In which case, the drive electrode of the third switch $Tr_4$ is also connected to the row select electrode 14. Thus, when the signal provided by this electrode closes the switch $Tr_3$, it opens the switch $Tr_4$, and vice versa. In this configuration, the cathodes again form a single common upper layer 18 that is connected directly to the ground electrode 17, which corresponds to the second output terminal of the generator.

Figure 2:
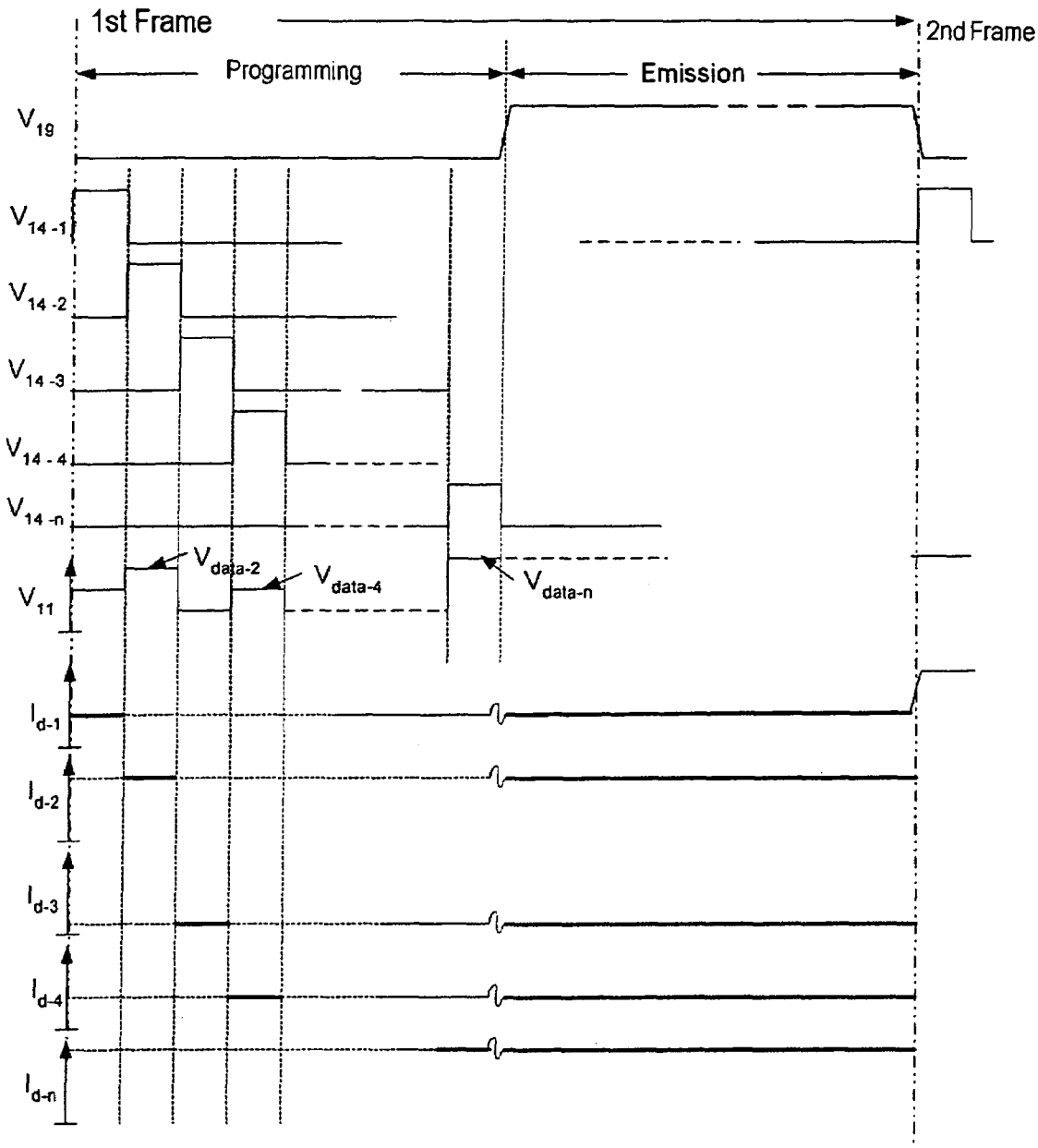
FIG. 2 illustrates a timing diagram for controlling the circuits of the display shown in FIG. 1, according to one way of implementing the drive method according to the invention.

One way of implementing the method of driving the display according to the invention will now be described with reference to FIG. 2, for the purpose of displaying a succession of image frames. Each image is therefore made up in a manner known per se from a set of image data, each datum being associated, on the one hand, with a pixel of this image and, on the other hand, with a representative voltage with which the circuit of this pixel is to be addressed.

A row of pixel circuits is selected by closing both the first switch $Tr_1$ and the second switch $Tr_3$ of each of the pixel circuits 10 of this row by means of a logic signal sent onto the select electrode 14 of this row. A pixel circuit 10 of a selected row is addressed when the switch $Tr_4$ is open, by applying a voltage representative of the image datum of this pixel to the non-inverting input + of the operational amplifier 2 of the address circuit corresponding to the column to which this circuit belongs.

The displaying operation for each image comprises a programming phase and an emission phase.

In the programming phase, the switch $Tr_4$ is opened by applying a suitable logic signal $V_{19}$ to its drive electrode 19. By means of the select circuit, each row of pixel circuits is selected in succession by applying, to the electrode 14-1, 14-2, 14-3, 14-4, . . . , **14-*n*** of this row, a logic signal $V_{14\text{-}1}$, $V_{14\text{-}2}$, $V_{14\text{-}3}$, $V_{14\text{-}4}$, . . . , $V_{14\text{-}n}$ suitable for closing the first $Tr_1$ and second $Tr_3$ switches of each pixel circuit of this row.

Once a first row 14-1 has thus been selected, the voltage $V_{data\text{-}1}$ representative of the image datum corresponding to this pixel is applied, via the electrode 11, to the non-inverting input + of the operational amplifier 2 of each circuit 25 for addressing the pixels of this row 14-1. Since the second input terminal (k, the cathode) of the diode 1 of this pixel is "floating", as the switch $Tr_4$ is open, the current generated by the supply generator therefore flows via the modulation transistor $Tr_2$ of the circuit of this pixel and via the resistor 4 of the address circuit 25. The operational amplifier 2 of the address circuit 25 therefore delivers, as output, to the modulation transistor $Tr_2$ of the circuit for this pixel, a drive voltage capable of generating, in this resistor and this transistor, a current $I_{d\text{-}1}$ proportional to the representative voltage $V_{data\text{-}1}$ with which this circuit is addressed, i.e. $I_{d\text{-}1}=V_{data\text{-}1}/R_1$. The selection time for the row 14-1 is suitable for charging the capacitor $C_1$ of this pixel circuit with this drive voltage.

In a variant, when the switch $Tr_4$ is open, the second input terminal (k, the cathode) of the diode 1 is connected to a constant potential suitable for preventing any significant flow of current in the diode, for example a potential equal to $V_{DD}$ or higher.

Since a current representative of an image datum is thus programmed in each pixel circuit of the row 14-1 by charging with a drive voltage capable of generating this current, a second row 14-2 is then selected so as to programme a current $I_{d\text{-}2}=V_{data\text{-}2}/R_1$ proportional to the voltage $V_{data\text{-}2}$ representative of the image datum that corresponds to the pixel of the row 14-2 that is addressed by the same address circuit 25, and to charge the capacitor $C_1$ of this pixel circuit with a drive voltage capable of programming this current $I_{d\text{-}2}$.

Next, each other row 14-3, 14-4, . . . , **14-*n* of the display is selected in succession so as to programme, in the same way, currents $I_{d\text{-}3}$, $I_{d\text{-}4}$, . . . , $I_{d\text{-}n}$ that are proportional to the voltages $V_{data\text{-}3}$, $V_{data\text{-}4}$, . . . , $V_{data\text{-}n}$ representative of the image data for the other pixels addressed by the same address circuit 25**.

When all the pixel circuits of all the rows have thus been programmed, the system passes to the emission phase. The switch $Tr_4$ is then closed by applying a suitable logic signal $V_{19}$ to its drive electrode 19. The current generated by the supply generator then flows, in each pixel circuit, via the modulation transistor $Tr_2$ and via the diode 1 of this circuit. Since the capacitor $C_1$ therefore maintains the drive voltage with which the capacitor was precharged, this being capable of generating, in the transistor $Tr_2$, a current $I_d$ proportional to the voltage representative of the image datum for this pixel, the current that flows in each diode is proportional to the voltage representative of the image datum for this pixel. The image frame is therefore completely displayed on the display.

The current flowing in each emitter during this emission phase is equal to the programmed current in each pixel circuit during the programming phase, and is therefore strictly proportional to the voltage representative of the image datum addressed to each pixel circuit during the programming phase. One advantage of the invention is that this current does not depend on the trip threshold voltages of the current modulation transistors of each circuit, nor on the current-voltage characteristics of the emitters, nor on any drift in these voltages and/or these characteristics.

The end of this emission phase marks the end of a frame being displayed, the system then passing to a second frame, with the two phases that have just been described being reiterated, and so on for displaying the various frames that follow on from one another.

The invention claimed is:

1. Active-matrix display comprising an array of light emitters of the current-controllable type and an array of pixel circuits, each comprising at least one of said emitters that are distributed in rows and columns, at least one generator for supplying said emitters having first and second supply output terminals, at least one circuit capable of selecting pixel circuits for any one row and at least one circuit capable of simultaneously addressing a voltage representative of an image datum to be displayed at each of the pixel circuits of any one row selected, where each pixel circuit comprises, in addition to at least one emitter:

a voltage-controlled current modulation transistor, comprising a voltage drive electrode and two current electrodes, namely what is called a source electrode and what is called a drain electrode which is connected to said first supply output terminal of the at least one generator;

a first switch and a second switch, each provided with a drive electrode; and a memory element capable of charging and maintaining, over the duration of display of an image, a drive voltage on said drive electrode of the modulation transistor, in which the at least one data address circuit comprises, for each column of pixels, first and second column electrodes, a differential amplifier having an output connected to said first column electrode, an inverting input connected to said second column electrode, and a non-inverting input for addressing said voltage representative of an image datum, said first column electrode being able to be connected to the drive electrode of the modulation transistor of each of the pixel circuits of said column by means of said first switch of this circuit, said second column electrode being able to be connected to said source electrode of the current modulation transistor of each of the same pixel circuits by means of said second switch of this circuit and in which the at least one row select circuit comprises, for each row of pixels, at least one row electrode that is connected to the drive electrode of the first and second switches of each of the pixel circuits of this row, wherein:

the at least one data address circuit comprises, for each column of pixels, a passive element having two terminals, one being connected to said second column electrode of said column, the other being connected to the second supply output terminal of the at least one generator; and said display includes at least a third switch able to connect, through the at least one emitter of each of the pixel circuits, said source electrode of the current modulation transistor of said pixel circuit to the second supply output terminal of the at least one generator.

2. Display according to claim 1, wherein said passive element is a resistor.

3. Display according to claim 2, wherein each current modulation transistor is an n-type transistor.

4. Display according to claim 3, wherein said emitters are organic light-emitting diodes.

5. Display according to claim 4, wherein said diodes each comprise an organic electroluminescent layer inserted between an anode formed by a lower conducting layer in contact with said active matrix and a cathode formed by an upper conducting layer.

6. Display according to claim 5, wherein the cathodes of the various diodes form one and the same conducting layer common to all the diodes.

7. Display according to claim 1, wherein, each emitter having two supply input terminals, namely an anode and a cathode:

in each pixel circuit, the anode of the at least one emitter is connected to the source electrode of the modulation transistor of this circuit; and the at least one third switch is able to connect to the cathode of the at least one emitter of each of the pixel circuits to the second supply output terminal of the at least one generator.

8. Method of driving a display according to claim 1 for displaying a succession of image frames, each image being made up of a set of image data, each datum being associated with a pixel of this image and with a representative voltage to be addressed to the circuit of this pixel, wherein it comprises, for displaying each image, a suitable programming phase for programming at least one set of pixel circuits in order to charge, in the memory element of each of the circuits of this set, a drive voltage capable of generating, via the modulation transistor of said circuit and the passive element of the address circuit for this circuit, a current proportional to the representative voltage addressed to this circuit, and an emission phase in which the emitters of the circuits of this set emit in which, for each of the circuits of this set, the same drive voltage is maintained by the memory element on the drive electrode of the modulation transistor of this circuit so as to generate, via the modulation transistor of said circuit and the at least one emitter of this pixel circuit, the same current $I_d$ as during the programming phase.

9. Drive method according to claim 8, wherein, during each address phase, the at least one third switch, which is able to connect, via the at least one emitter of each of the pixel circuits of said set, the source electrode of the current modulation transistor of said pixel circuit, to the second supply output terminal of the at least one generator, is open and in that, during each emission phase, the at least one third switch is closed.

10. Drive method according to claim 9, wherein, during each address phase for a set of pixel circuits belonging to different rows, each of said different rows of pixel circuits is selected, by means of the at least one selection circuit, by applying, to the electrode of each row selected in succession, a logic signal capable of closing the first and second switches of each pixel circuit of said row belonging to said set.

11. Drive method according to claim 10, wherein, during said selection of each row of pixel circuits of said set, the voltage representative of the image datum that corresponds to said pixel is applied, by means of the at least one address circuit, to the non-inverting input of the operational amplifier of each pixel circuit of said row belonging to said set.

* * * * *